US011647851B1

(12) United States Patent
Montalto

(10) Patent No.: US 11,647,851 B1
(45) Date of Patent: May 16, 2023

(54) BEDDING APPARATUS AND METHOD OF MAKING SAME

(71) Applicant: FRANCO MANUFACTURING CO. INC., Metuchen, NJ (US)

(72) Inventor: Kathy Marie Montalto, Metuchen, NJ (US)

(73) Assignee: FRANCO MANUFACTURING CO. INC., Metuchen, NJ (US)

( * ) Notice: Subject to any disclaimer, the term of this patent is extended or adjusted under 35 U.S.C. 154(b) by 153 days.

(21) Appl. No.: 17/144,590

(22) Filed: Jan. 8, 2021

Related U.S. Application Data

(60) Provisional application No. 62/958,391, filed on Jan. 8, 2020.

(51) Int. Cl.
*A47G 9/02* (2006.01)
*A47G 9/04* (2006.01)
*A47D 15/00* (2006.01)

(52) U.S. Cl.
CPC ..... *A47G 9/0246* (2013.01); *A47D 15/008* (2013.01); *A47G 9/0253* (2013.01); *A47G 9/04* (2013.01)

(58) Field of Classification Search
CPC ..... A47G 9/0246; A47G 9/04; A47G 9/0253
See application file for complete search history.

(56) References Cited

U.S. PATENT DOCUMENTS 6,886,197 B1 * 5/2005 Madigan ..... A47G 9/02 5/493
2003/0154549 A1 * 8/2003 Landry ..... A47D 15/02 5/923
2004/0172754 A1 * 9/2004 Brooks ..... A47C 27/002 5/737
2009/0044337 A1 * 2/2009 McKee ..... A47G 9/02 5/496
2019/0365122 A1 * 12/2019 Gupta ..... A47G 9/0246

OTHER PUBLICATIONS

Disabled World (Year: 2017).*
SwissAire (Year: 2019).*

* cited by examiner

*Primary Examiner* — Robert G Santos
*Assistant Examiner* — Adam C Ortiz
(74) *Attorney, Agent, or Firm* — John Maldjian; Stevens & Lee PC

(57) ABSTRACT

Disclosed is a bedding apparatus. The bedding apparatus comprising: a snuggle bedsheet adapted to fit over a mattress, wherein the snuggle bedsheet comprises: a sheet fabric adapted to cover a top portion of the mattress; an attachment fabric having a top end and a bottom end such that the top end of the attachment fabric is attached to the sheet fabric to enclose the mattress; and a spandex sheet attached at a middle area of the sheet fabric, comprising two longitudinal sides and two lateral sides, wherein the longitudinal sides are stitched to the sheet fabric and are longer than the lateral sides, wherein both lateral sides are configured to be open at all times.

20 Claims, 15 Drawing Sheets

BEDDING APPARATUS AND METHOD OF MAKING SAME

CROSS REFERENCE TO RELATED APPLICATION

This application claims benefit and priority to U.S. Provisional Patent Application Ser. No. 62/958,391, filed Jan. 8, 2020, entitled, "BED SHEET AND METHOD OF MAKING SAME" which is incorporated herein by reference in its entirety.

FIELD OF INVENTION

Embodiments disclosed herein relate, in general, to a bedding apparatus, and more particularly, to a bedding apparatus, with an expandable and stretchable center portion.

BACKGROUND

Bedsheets, quilts and blankets are available, which are used to provide comfort to a user while sleeping. Traditionally, the bedsheets, the quilts and the blankets are provided, which can be simply laid on a bed or can be tucked at one end under a mattress. However, during sleep, these bedsheets, quilts, and blankets tend to displace from their position, thus providing discomfort to the user. Moreover, the user has to wake up multiple times due to the discomfort caused by the displaced quilts and blankets which can further cause health issues for the user.

Moreover, in case of young children, the bedsheets, the quilts, and the blankets fail to provide a prolonged comfort throughout a night. Conventional bedsheets, quilts and blankets do not provide a comfortable pressure that can be helpful in releasing a stress while the user is asleep. To overcome aforementioned issues, various bed lines have been designed such as top bedsheets that are adapted to fit around a mattress so that the bedsheets does not easily slide off from the mattress and remains flat to the mattress. However, such bedsheets lack in providing any kind of elasticized material at a pocket end of the bedsheet, which in turn creates a difficulty for a sleeping user to accommodate feet inside the pocket of the bedsheet.

Therefore, there is a need for a bedding apparatus that can provide a full autonomy to the user including children, to get in and out of the bed with an ideal stimulation and a higher energy.

SUMMARY

Embodiments in accordance with the present invention provide a bedding apparatus, comprising: a snuggle bedsheet adapted to fit over a mattress, wherein the snuggle bedsheet comprises a sheet fabric adapted to cover a top portion of the mattress. Further, the snuggle bedsheet comprises an attachment fabric having a top end and a bottom end such that the top end of the attachment fabric is attached to the sheet fabric to enclose the mattress. Further, the snuggle bedsheet comprises a spandex sheet attached at a middle area of the sheet fabric, wherein the spandex sheet comprises a proximal end having a proximal opening and a distal end having a distal opening.

Embodiments in accordance with the present invention further provide a bedding apparatus, comprising: a snuggle bedsheet adapted to fit over a mattress, wherein the snuggle bedsheet comprises a sheet fabric adapted to cover a top portion of the mattress. Further, the snuggle bedsheet comprises an attachment fabric having a top end and a bottom end such that the top end of the attachment fabric is attached to the sheet fabric to enclose the mattress, wherein the attachment fabric is a wrap knitted fabric. Further, the snuggle bedsheet comprises a spandex sheet attached at a middle area of the sheet fabric, wherein the spandex sheet comprises a proximal end having a proximal opening and a distal end having a distal opening.

Embodiments in accordance with the present invention further provide a bedding apparatus, comprising: a snuggle bedsheet adapted to fit over a mattress, wherein the snuggle bedsheet comprises: a sheet fabric adapted to cover a top portion of the mattress; an attachment fabric having a top end and a bottom end such that the top end of the attachment fabric is attached to the sheet fabric to enclose the mattress. Further, the snuggle bedsheet comprises a holding band attached along the bottom end of the attachment fabric to keep the attachment fabric affixed to the mattress. Further, the snuggle bedsheet comprises a spandex sheet attached at a middle area of the sheet fabric, wherein the spandex sheet comprises a proximal end having a proximal opening and a distal end having a distal opening.

Embodiments of the present invention may provide a number of advantages depending on its particular configuration. Embodiments of the present invention may provide a snuggle bedsheet that may relieve a stress and promote a calmness in a user. Further, embodiments of the present invention may provide a stretchable snuggle bedsheet that may exert a pressure on the user that may be helpful for the user in releasing the stress while sleeping. The pressure may not be overpowering but instead feels like being wrapped up in a gentle hug. Next, embodiments of the present invention may provide a stretchable snuggle bedsheet that may provide the user a full autonomy to get in and out of a bed with an ideal stimulation offering deep touch pressure. Embodiments of the present invention are directed to a stretchable snuggle bed sheet that provides compression as the user such as, a child, grows.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

Figure 1A:
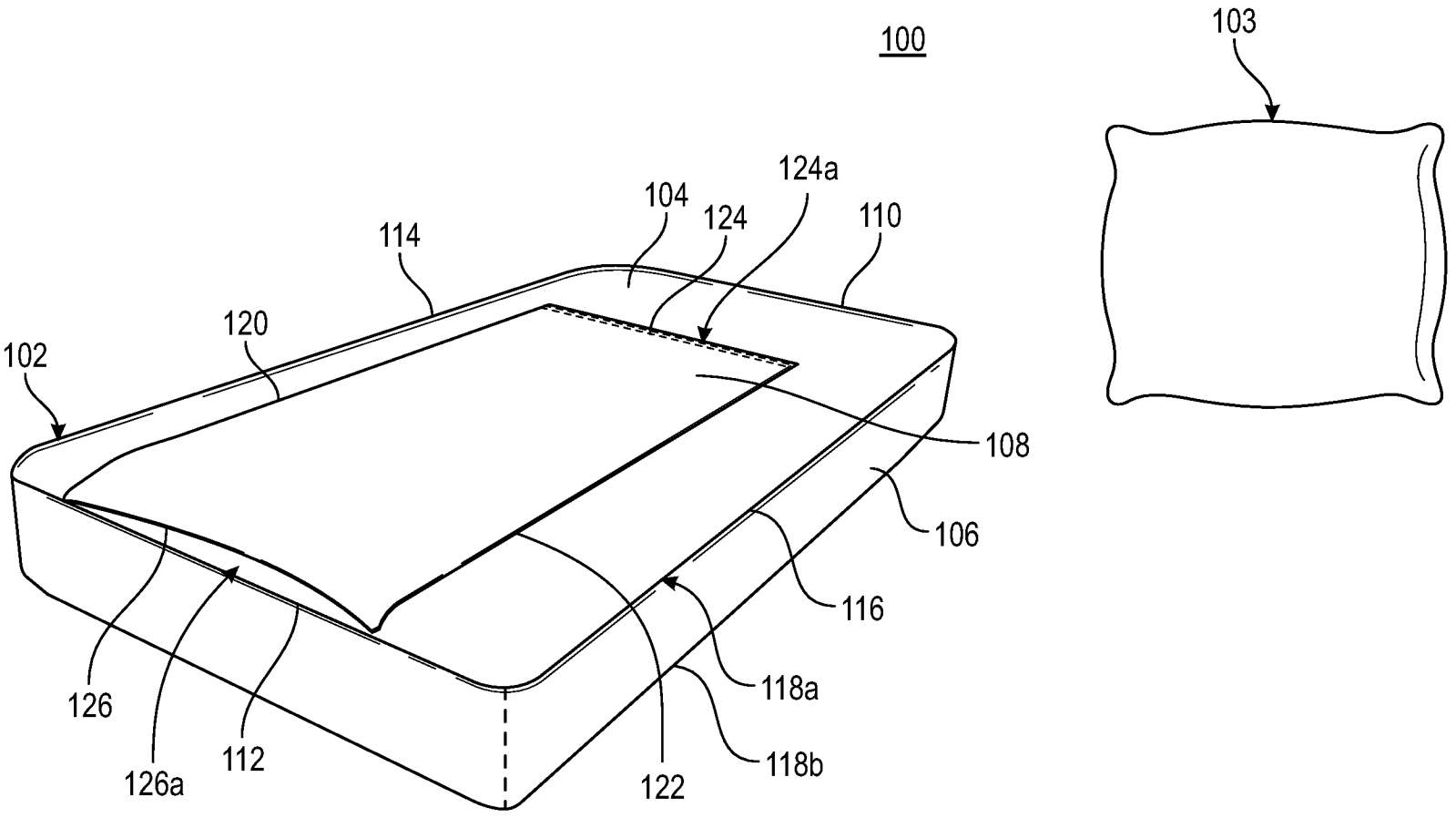
FIG. 1A illustrates a bedding apparatus, according to an embodiment of the present invention.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention will be described below in conjunction with an exemplary snuggle bed sheet. Embodiments of the present invention are not limited to any particular type of a snuggle bed sheet. Those skilled in the art will recognize the disclosed techniques may be used in any snuggle bed sheet.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

FIG. 1A illustrates a bedding apparatus 100, according to an embodiment of the present invention. The bedding apparatus 100 may comprise a snuggle bedsheet 102 and at least one pillowcase 103 (hereinafter referred to as the pillowcase 103). The snuggle bedsheet 102 may be a fitted bedsheet that may be adapted to fit over a mattress (not shown in FIG. 1A). Further, the snuggle bedsheet 102 may be designed to provide a soft and a warmth comfort to a user while sleeping on the snuggle bedsheet 102. Furthermore, the snuggle bedsheet 102 may be designed to relieve a stress and promote a calmness in the user.

In an embodiment of the present invention, the snuggle bedsheet 102 may be an expandable bedsheet. The snuggle bedsheet 102 may be designed to expand in multiple directions. Further, the expandability of the snuggle bedsheet 102 may provide a capability to the snuggle bedsheet 102 to fit over any size of the mattress. According to an embodiment of the present invention, the snuggle bedsheet 102 may comprise a sheet fabric 104, an attachment fabric 106, and a spandex sheet 108. The sheet fabric 104 may be adapted to cover a top portion of the mattress, according to an embodiment of the present invention. The sheet fabric 104 may be made up of a material such as, but not limited to, a micro mink material, a micro plush material, and so forth. In an embodiment of the present invention, the sheet fabric 104 may be made up of a microfiber sheet. Embodiments of the present invention are intended to include or otherwise cover any type of the material for the sheet fabric 104, including known, related art, and/or later developed technologies. The microfiber sheet may be a synthetic fiber that may be finer than one denier/thread. Further, a diameter of the fiber of the microfiber sheet may be less than 10 Micrometers (μm). Furthermore, the microfiber sheet may be made up of a material such as, but not limited to, a nylon polymer, a polyester, a wood pulp, and so forth. Embodiments of the present invention are intended to include or otherwise cover any material of the microfiber sheet, including known, related art, and/or later developed technologies. The sheet fabric 104 may comprise an upper side 110, a lower side 112, a left side 114, and a right side 116, according to embodiments of the present invention. In an embodiment of the present invention, the upper side 110, the lower side 112, the left side 114, and the right side 116 of the sheet fabric 104 may form a rectangular shape. In another embodiment of the present invention, the upper side 110, the lower side 112, the left side 114, and the right side 116 of the sheet fabric 104 may form a square shape.

According to embodiments of the present invention, the sheet fabric 104 may be, but not limited to, a plain sheet fabric, a printed sheet fabric, and so forth. In a preferred embodiment of the present invention, the sheet fabric 104 may be a color printed sheet fabric. Embodiments of the present invention are intended to include or otherwise cover any type of the sheet fabric 104, including known, related art, and/or later developed technologies. Further, a color of the sheet fabric 104 may be selected from a color system such as, but not limited to, a Pantone Matching System (PMS), in an embodiment of the present invention. Furthermore, the color of the sheet fabric 104 may be, but not limited to, a black, a yellow, a yellow 012, a PMS 300, a PMS 212, a PMS 201, a PMS 179, a PMS 2144, a PMS 282, a PMS 2152, and so forth. Embodiments of the present invention are intended to include or otherwise cover any color for the sheet fabric 104, including known, related art, and/or later developed technologies.

According to embodiments of the present invention, the upper side 110, the lower side 112, the left side 114, and the right side 116 of the sheet fabric 104 may be designed to be fixedly attached with the mattress using the attachment fabric 106. In a preferred embodiment of the present invention, the attachment fabric 106 may be a wrap knit fabric. Further, the attachment fabric 106 may comprise a top end 118*a* and a bottom end 118*b*. The top end 118*a* of the attachment fabric 106 may be attached to the upper side 110, the lower side 112, the left side 114, and the right side 116 of the sheet fabric 104 to cover a plurality of sides of the mattress and a part of a bottom portion (not shown in the FIG. 1A) of the mattress. Further, the attachment fabric 106 may be made of a material such as, but not limited to, a thread, a yarn, a pearl cotton, a rayon floss, and so forth. Embodiments of the present invention are intended to include or otherwise cover any type of the material for the attachment fabric 106, including known, related art, and/or later developed technologies. The attachment fabric 106 may be having a wide opening area (not shown) that may be designed to enable the snuggle bedsheet 102 to fit over the mattress of a variety of sizes, in an embodiment of the present invention.

Further, the top end 118*a* of the attachment fabric 106 may be attached to the upper side 110, the lower side 112, the left side 114, and the right side 116 of the sheet fabric 104 through a stitching, in an embodiment of the present invention. In an embodiment of the present invention, the stitching may be done with a colored thread matching to a color of the sheet fabric 104. Further, the attachment fabric 106 may be solid knitted mesh skirt, according to an embodiment of the present invention. Furthermore, the color of the attachment fabric 106 may be selected from the color system such as, but not limited to, the Pantone Matching System (PMS), in an embodiment of the present invention. Furthermore, the color of the attachment fabric 106 may be, but not limited to, the black, the yellow, the yellow 012, the PMS 300, the PMS 212, the PMS 201, the PMS 179, the PMS 2144, the PMS 282, the PMS 2152, and so forth. Embodiments of the present invention are intended to include or otherwise cover any color for the attachment fabric 106, including known, related art, and/or later developed technologies. In an embodiment of the present invention, the attachment fabric 106 may be stretchable in a vertically downward direction. The attachment fabric 106 may be fabricated to be stretchable to a range of 18 inches to 23 inches. In a preferred embodiment of the present invention, the attachment fabric 106 may be stretchable in the vertically downward direction up to 21 inches.

Further, in an embodiment of the present invention, the spandex sheet 108 may be securely attached to a middle area of the sheet fabric 104. The attachment of the spandex sheet 108 may be capable to avoid a displacement of the spandex sheet 108 from its affixed position while the user is sleeping on the mattress. In another embodiment of the present invention, the spandex sheet 108 may be removably attached to the middle area of the sheet fabric 104. The spandex sheet 108 may be attached to the middle area of the sheet fabric 104 through the stitching, in an embodiment of the present invention. In an embodiment of the present invention, the stitching may be done with a thread of the color that matches to the color of the sheet fabric 104 and the spandex sheet 108. In a preferred embodiment of the present invention, the spandex sheet 108 may form a comfortable spandex sleeve that may enable the user to move into a warm and a comfortable position while sleeping.

According to an embodiment of the present invention, the spandex sheet 108 may be having at least two closed ends such as a first end 120 and a second end 122 that may be closed by the stitching. Further, the first end 120 of the spandex sheet 108 may be stitched parallel to the left side 114 of the sheet fabric 104. Furthermore, the second end 122 of the spandex sheet 108 may be stitched parallel to the right side 116 of the sheet fabric 104. The spandex sheet 108 may further comprise at least two open ends such as a proximal end 124 and a distal end 126 that may enable the user to cover a part of a user's body into an enclosed space formed by the spandex sheet 108. According to an embodiment of the present invention, the proximal end 124 of the spandex sheet 108 may comprise a proximal opening 124*a* to enable the user to snuggle into the spandex sheet 108. In another embodiment of the present invention, the distal end 126 of the spandex sheet 108 may comprise a distal opening 126*a* to enable the user to move into the warm and the comfortable position inside the spandex sheet 108. In an embodiment of the present invention, the spandex sheet 108 may be stretchable in a lengthwise direction that may enable a wide expansion of the enclosed space of the spandex sheet 108 based on a requirement of the user. In an exemplary scenario, the user may have a height that may require the spandex sheet 108 to stretch in the lengthwise direction towards the lower side 112 of the sheet fabric 104 in order to accommodate a body of the user within the spandex sheet 108. In another embodiment of the present invention, the spandex sheet 108 may be stretchable in a transverse direction that may enable the wide expansion of the enclosed space of the spandex sheet 108 based on the requirement of the user. In an exemplary scenario, the user may have a bulky body that may require the spandex sheet 108 to stretch in the transverse direction towards the left side 114 and the right side 116 of the sheet fabric 104 to accommodate the body of the user within the spandex sheet 108. In yet another embodiment of the present invention, the spandex sheet 108 may be more stretchable in the lengthwise direction than in the transverse direction. In yet another embodiment of the present invention, the spandex sheet 108 may be more stretchable in the transverse direction than in the lengthwise direction.

Further, according to embodiments of the present invention, the spandex sheet 108 may be, but not limited to, a lycra sheet, an elastane sheet, a synthetic fiber sheet, an expandable sheet, a stretchable sheet, and so forth. Embodiments of the present invention are intended to include or otherwise cover any type of the spandex sheet 108, including known, related art, and/or later developed technologies. According to an embodiment of the present invention, the spandex sheet 108 may be made up of a two-way stretchable spandex fabric. According to another embodiment of the present invention, the spandex sheet 108 may be made up of a 250 Grams per Square Meter (GSM) spandex fabric.

Further, the spandex sheet 108 may be, but not limited to, a color printed spandex sheet. Furthermore, the spandex sheet 108 may comprise a plurality of prints for example, but not limited to, an illustration, a pattern, a cartoon character, a text, and so forth. Embodiments of the present invention are intended to include or otherwise cover any type of the plurality of prints, including known, related art, and/or later developed technologies. A color of the spandex sheet 108 may be selected from the color system such as, but not limited to, the Pantone Matching System (PMS), in an embodiment of the present invention. Furthermore, the color of the spandex sheet 108 may be, but not limited to, the black, the yellow, the yellow 012, the PMS 300, the PMS 212, the PMS 201, the PMS 179, the PMS 2144, the PMS 282, the PMS 2152, and so forth. Embodiments of the present invention are intended to include or otherwise cover any color for the spandex sheet 108, including known, related art, and/or later developed technologies.

Further, the pillowcase 103 may be adapted to cover a pillow for protecting the pillow from dust mites and stains, in an embodiment of the present invention. Furthermore, the pillowcase 103 may comprise a plurality of prints such as, but not limited to, an illustration, a cartoon character, a text, and so forth. Embodiments of the present invention are intended to include or otherwise cover any type of the plurality of prints, including known, related art, and/or later developed technologies. The pillowcase 103 may be of any shape such as, but not limited to, a rectangle, a square, and so forth. Embodiments of the present invention are intended to include or otherwise cover any shape of the pillowcase 103, including known, related art, and/or later developed technologies. Further, the pillowcase 103 may be made up of a material such as, but not limited to, a cotton, a linen, a wool, a microfiber, a micro mink material, a micro plush material, and so forth. Embodiments of the present invention are intended to include or otherwise cover any material for the pillowcase 103, including known, related art, and/or later developed technologies. Furthermore, a color of the pillowcase 103 may be selected from the color system such as, but not limited to, the Pantone Matching System (PMS), in an embodiment of the present invention. The color of the pillowcase 103 may be, but not limited to, the black, the yellow, the yellow 012, the PMS 300, the PMS 212, the PMS 201, the PMS 179, the PMS 2144, the PMS 282, the PMS 2152, and so forth. Embodiments of the present invention are intended to include or otherwise cover any color for the pillowcase 103, including known, related art, and/or later developed technologies.

Figure 1B:
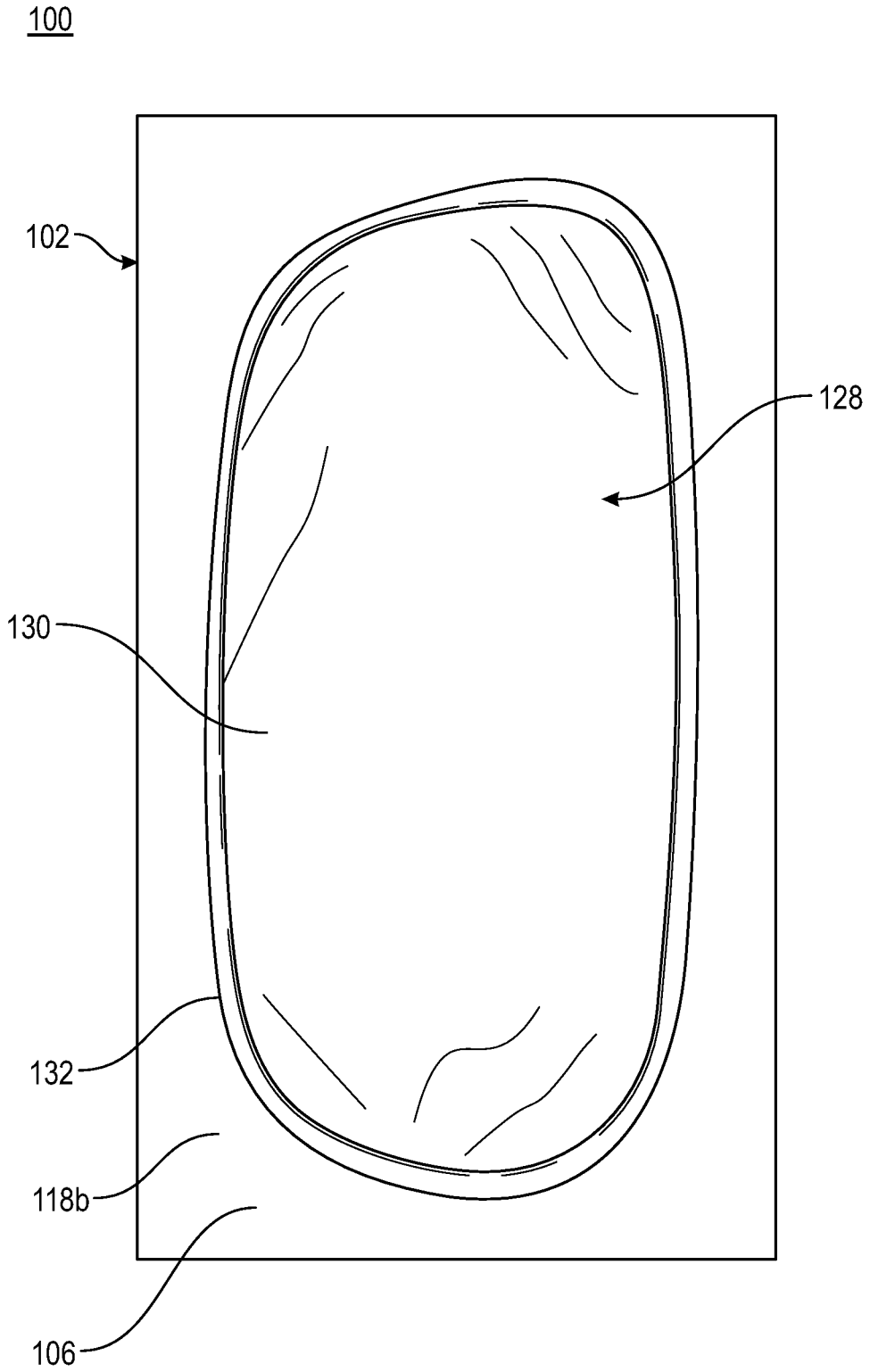
FIG. 1B illustrates a bottom view of the bedding apparatus having of a snuggle bedsheet installed on a mattress, according to an embodiment of the present invention.

FIG. 1B illustrates a bottom view of the bedding apparatus 100 having of the snuggle bedsheet 102 installed on a mattress 128, according to an embodiment of the present invention. The snuggle bedsheet 102 may comprise a holding band 132 attached along the bottom end 118*b* of the attachment fabric 106 to keep the attachment fabric 106 affixed to a bottom portion 130 of the mattress 128. In a preferred embodiment of the present invention, the holding band 132 may be an elastic band. Embodiments of the present invention are intended to include or otherwise cover any holding band 132, including known, related art, and/or later developed technologies. In an embodiment of the present invention, the holding band 132 may be a rectangular band. Further, the holding band 132 may be made up of a material such as, but not limited to, a natural rubber, a synthetic rubber, a monomer, and so forth. In a preferred embodiment of the present invention, the holding band 132 may be made up of a high quality athletic elastic trim. Embodiments of the present invention are intended to include or otherwise cover any material of the holding band 132, including known, related art, and/or later developed technologies that may be capable of providing an elasticity to the attachment fabric 106 to secure it with the mattress 128.

Figure 1C:
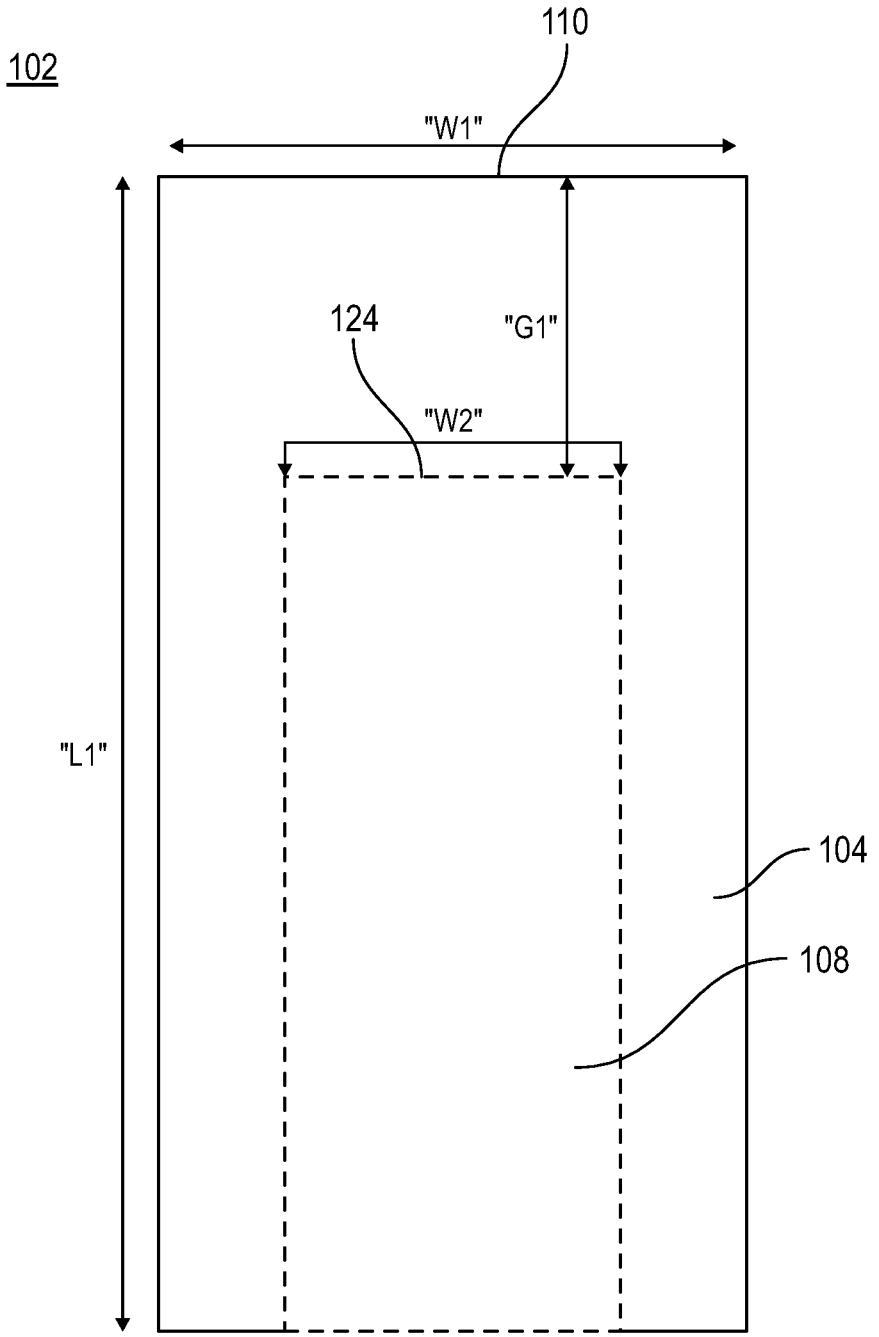
FIG. 1C illustrates dimensions of the snuggle bedsheet, according to an embodiment of the present invention.

FIG. 1C illustrates dimensions of the snuggle bedsheet 102, according to an embodiment of the present invention. The snuggle bedsheet 102 may comprise the sheet fabric 104 and the spandex sheet 108, as discussed in the FIG. 1A. According to embodiments of the present invention, a width W1 of the sheet fabric 104 may be in a range of 37 inches to 42 inches. In a preferred embodiment of the present invention, the width W1 of the sheet fabric 104 may be 39.5 inches. Further, a length L1 of the sheet fabric 104 may be in a range of 72 inches to 78 inches. In a preferred embodiment of the present invention, the length L1 of the sheet fabric 104 may be 75.5 inches. Furthermore, a width W2 of the spandex sheet 108 may be in a range of 20 inches to 26 inches. In a preferred embodiment of the present invention, the width W2 of the spandex sheet 108 may be 26 inches. In an embodiment of the present invention, a gap G1 between the upper side 110 of the sheet fabric 104 and the proximal end 124 of the spandex sheet 108 may be in a range of 20 inches to 26 inches. In a preferred embodiment of the present invention, the gap G1 between the upper side 110 of the sheet fabric 104 and the proximal end 124 of the spandex sheet 108 may be 22 inches.

Figure 1D:
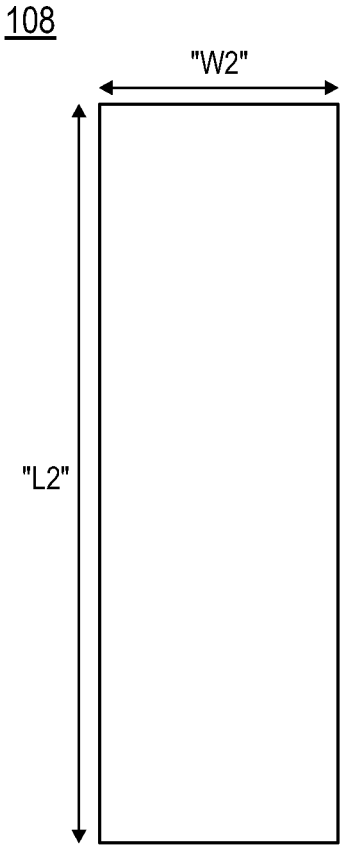
FIG. 1D illustrates dimensions of a spandex sheet, according to an embodiment of the present invention.

FIG. 1D illustrates dimensions of the spandex sheet 108, according to an embodiment of the present invention. The spandex sheet 108 may be designed to release a stress of the user by exerting a pressure on the user. The pressure exerted by the spandex sheet 108 may be such that the user experiences a gentle hug when wrapped inside the spandex sheet 108. According to embodiments of the present invention, a length L2 of the spandex sheet 108 may be in a range of 52 inches to 65 inches. In a preferred embodiment of the present invention, the length L2 of the spandex sheet 108 may be 61 inches. Furthermore, a width W2 of the spandex sheet 108 may be in a range of 20 inches to 26 inches. In another preferred embodiment of the present invention, the width W2 of the spandex sheet 108 may be 26 inches. According to embodiments of the present invention, a shape of the spandex sheet 108 may be, but not limited to, a square, a rectangle, and so forth. Embodiments of the present invention are intended to include or otherwise cover any shape of the spandex sheet 108, including known, related art, and/or later developed technologies.

Figure 1E:
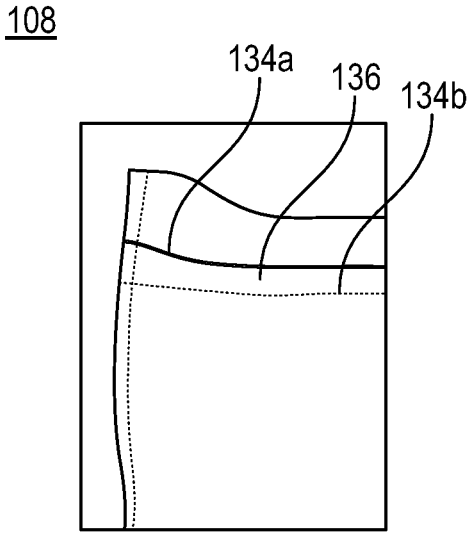
FIG. 1E illustrates an enlarged view of an attachment of the spandex sheet using a stitching, according to an embodiment of the present invention.

FIG. 1E illustrates an enlarged view of an attachment of the spandex sheet 108 using the stitching, according to an embodiment of the present invention. A stitching technique that may be used for attaching the spandex sheet 108 to the sheet fabric 104 may be one of, a zig-zag stitch, a backstitch, a blind stitch, and so forth. Embodiments of the present invention are intended to include or otherwise cover any type of the stitching technique, including known, related art, and/or later developed technologies. In a preferred embodiment of the present invention, the stitching technique may be, but not limited to, a top stitching 134*a*-134*b* (hereinafter referred to as 134), a double stitching 136, and so forth. As used herein, the "top stitching 134" refers to a sewing technique where a line of the stitching may be designed to be seen from outside of a material. According to embodiments of the present invention, the top stitching 134 may be done on the proximal end 124 and the distal end 126 of the spandex sheet 108 for a decorative or a functional purpose.

Further, the double stitching 136 may be done on the proximal end 124 and the distal end 126 (as shown in the FIG. 1A) of the spandex sheet 108 in order to provide a stronger seam for the spandex sheet 108.

Figure 1F:
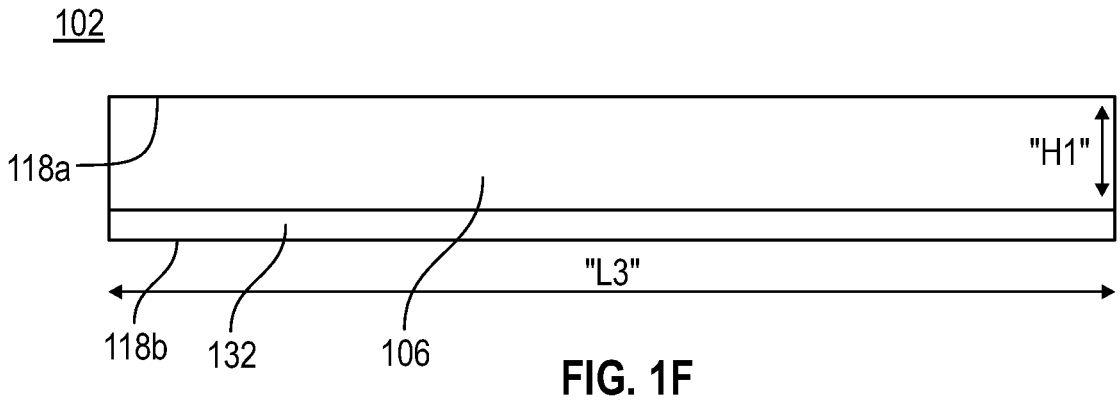
FIG. 1F illustrates a right-side view of an attachment fabric and a holding band of the snuggle bedsheet, according to an embodiment of the present invention.

FIG. 1F illustrates a right-side view of the attachment fabric 106 and the holding band 132 of the snuggle bedsheet 102, according to an embodiment of the present invention. The attachment fabric 106 may comprise the top end 118*a* and the bottom end 118*b*. The top end 118*a* of the attachment fabric 106 may be attached to the right side 116 of the sheet fabric 104, in an embodiment of the present invention. The bottom end 118*b* of the attachment fabric 106 may be attached to the holding band 132 that may be capable to hold to the attachment fabric 106 in place. According to embodiments of the present invention, a height H1 of the attachment fabric 106 may be in a range of 12 inches to 15 inches. In a preferred embodiment of the present invention, the height H1 of the attachment fabric 106 may be 14.5 inches. Further, a length L3 of the attachment fabric 106 may be in range of 193 inches to 197 inches. In a preferred embodiment of the present invention, the length L3 of the attachment fabric 106 may be 195 inches.

Figure 1G:
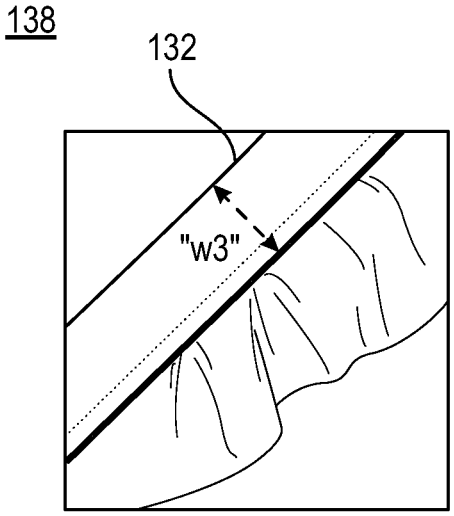
FIG. 1G illustrates an enlarged view of the holding band, according to an embodiment of the present invention.

FIG. 1G illustrates an enlarged view 138 of the holding band 132, according to an embodiment of the present invention. A width W3 of the holding band 132 may be in a range of 1 inch to 2 inches. In a preferred embodiment of the present invention, the width W3 of the holding band 132 may be 1.5 inches to securely hold the attachment fabric 106 in the place. Further, an elasticity of the holding band 132 may enable the user to easily remove and/or install the snuggle bedsheet 102 from and/or to the mattress 128 (as shown in the FIG. 1B).

Figure 1H:
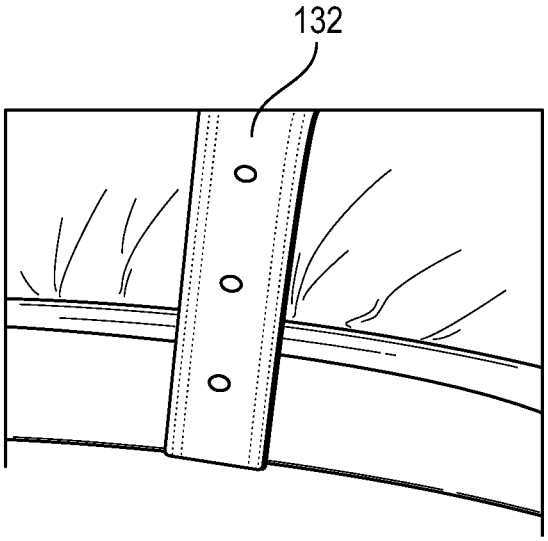
FIG. 1H illustrates another enlarged view of the holding band, according to an embodiment of the present invention.

FIG. 1H illustrates another enlarged view of the holding band 132, according to an embodiment of the present invention. The elastic used in the holding band 132 may be, but not limited to, a braided elastic, a woven elastic, a knitted elastic, and so forth. Embodiments of the present invention are intended to include or otherwise cover any type of elastic for the holding band 132, including known, related art, and/or later developed technologies. In an embodiment of the present invention, a length of the holding band 132 may be in a range of 82 inches to 86 inches. In a preferred embodiment of the present invention, the length of the holding band 132 may be 84.5 inches.

Figure 1I:
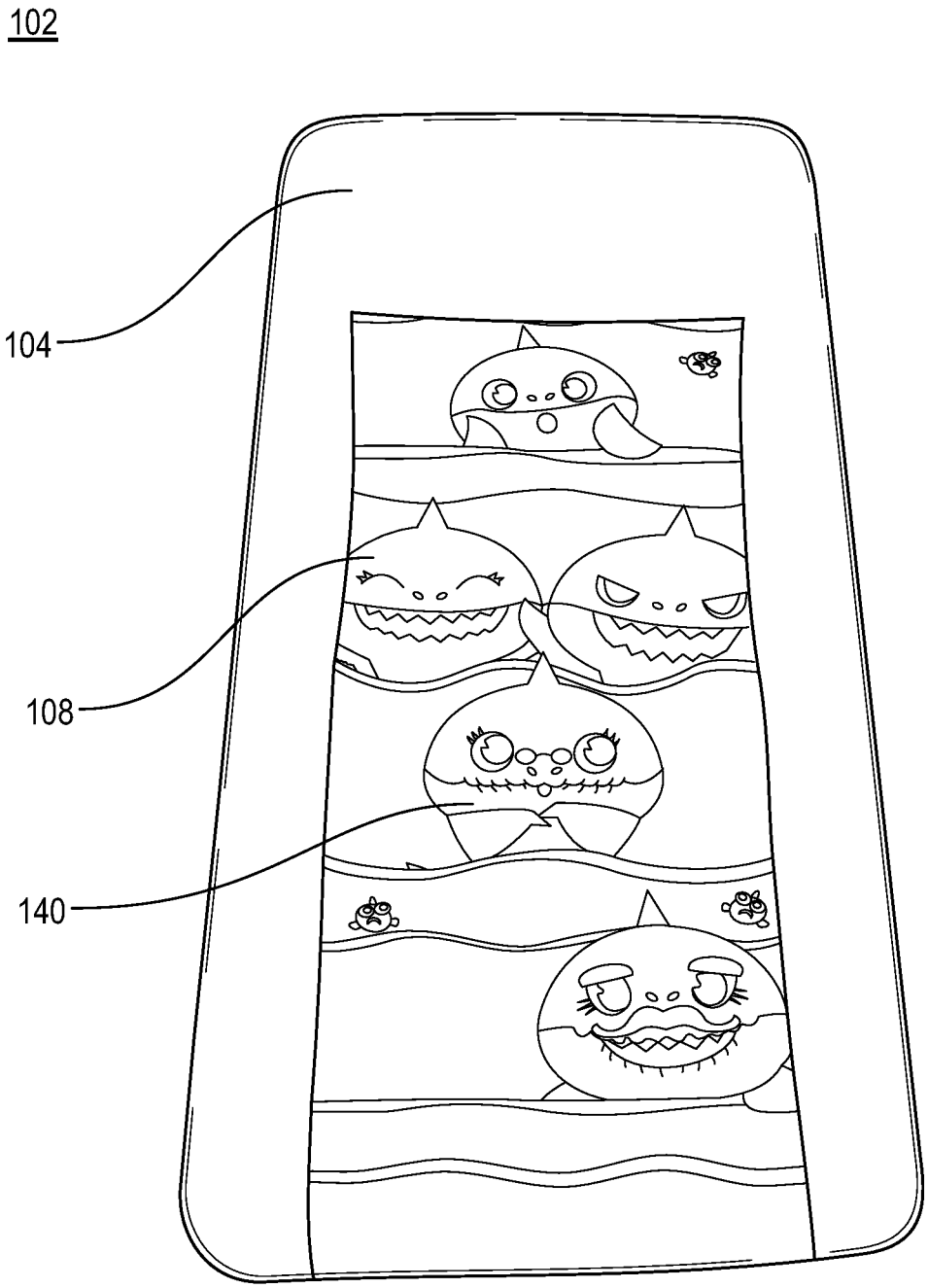
FIG. 1I illustrates a top view of the snuggle bedsheet, according to another embodiment of the present invention.

FIG. 1I illustrates a top view of the snuggle bedsheet 102, according to an exemplary embodiment of the present invention. The snuggle bedsheet 102 may comprise the sheet fabric 104 and the spandex sheet 108. The spandex sheet 108 may comprise a top surface 140 having a plurality of pre-defined patterns to attract the user, especially children. The pre-defined patterns may be, but not limited to, a two-dimensional (2D) pattern, a three-dimensional (3D) pattern, and so forth. Embodiments of the present invention are intended to include or otherwise cover any type of pre-defined patterns, including known, related art, and/or later developed technologies. In a preferred embodiment of the present invention, the plurality of pre-defined patterns may be one or more cartoon characters of troll's power. The pre-defined patterns may be printed on the top surface 140 of the spandex sheet 108 by using a printing technique. Further, the printing technique may be, but not limited to, a digital 3D printing, a discharge printing, a resist printing, and so forth. Embodiments of the present invention are intended to include or otherwise cover any type of the printing technique, including known, related art, and/or later developed technologies.

Figure 1J:
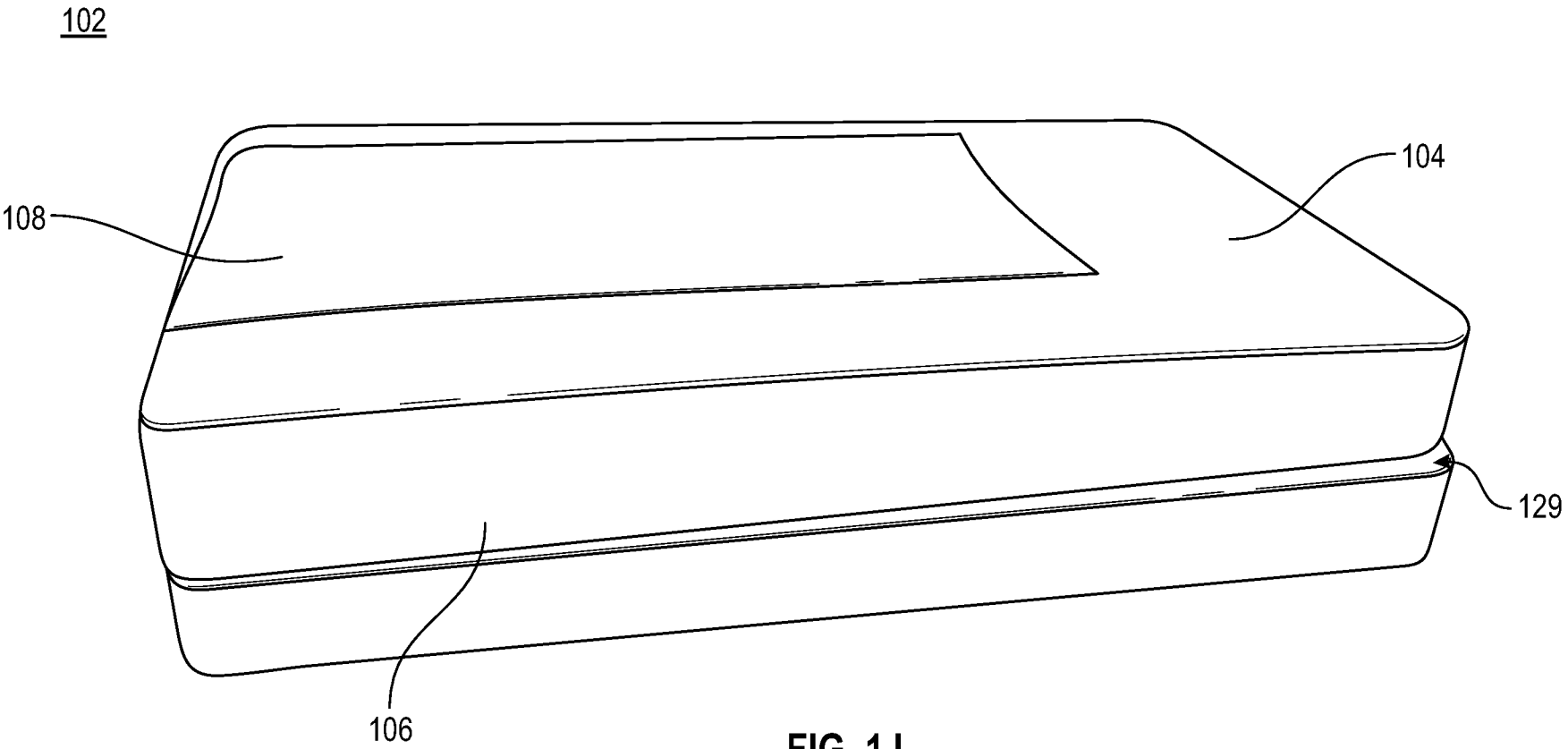
FIG. 1J illustrates a side perspective view of the snuggle bedsheet installed onto a mattress, according to an embodiment of the present invention.

FIG. 1J illustrates a side perspective view of the snuggle bedsheet 102 installed onto the mattress 128, according to an embodiment of the present invention. In an embodiment of the present invention, the snuggle bedsheet 102 may comprise the sheet fabric 104, the attachment fabric 106, and the spandex sheet 108 that may be having a plain top surface. The plain top surface may be of any color such as, but not limited to, black, yellow, blue, and so forth. Embodiments of the present invention are intended to include or otherwise cover any color, including known, related art, and/or later developed technologies. In a preferred embodiment of the present invention, the color may be a white color.

Figure 1K:
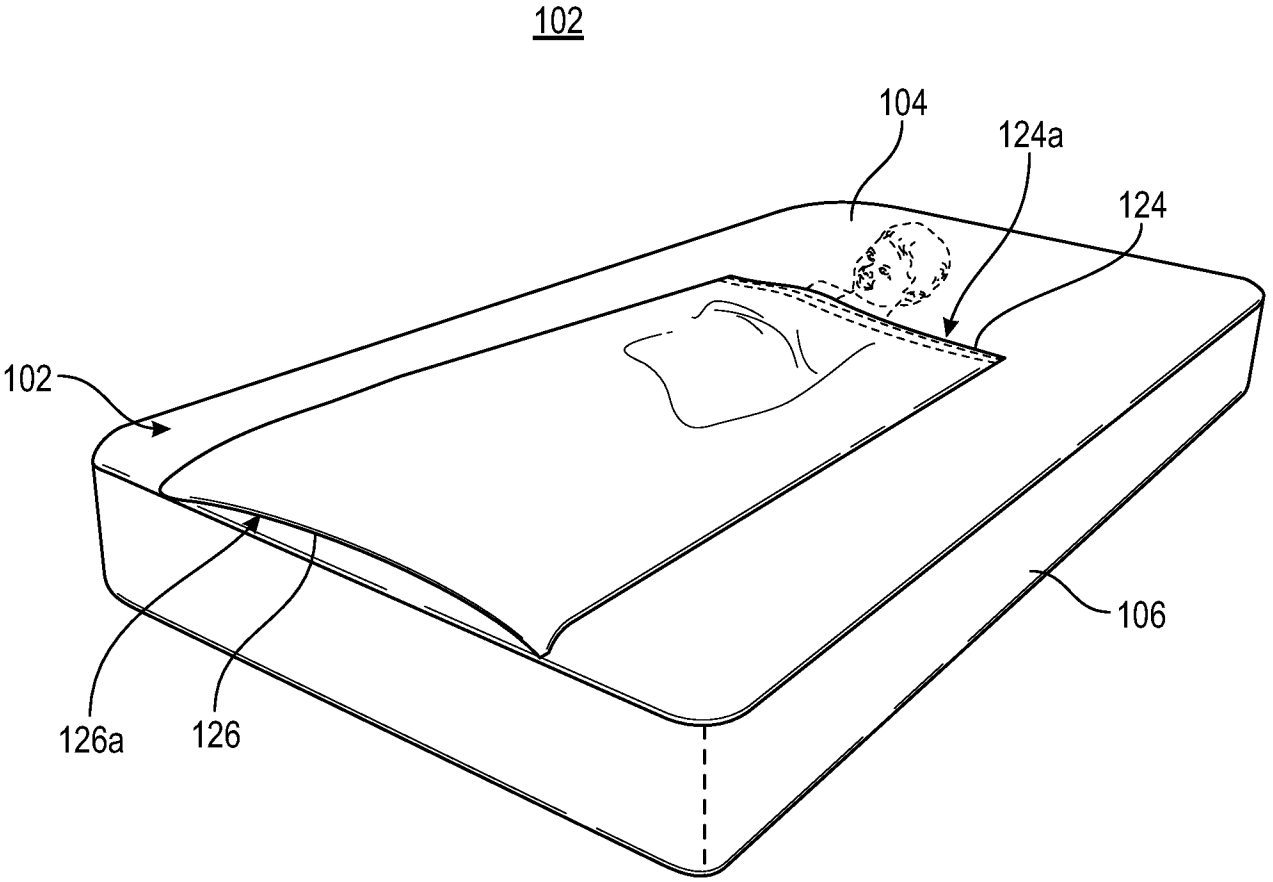
FIG. 1K illustrates a user using the snuggle bedsheet, according to an embodiment of the present invention.

FIG. 1K illustrates the user using the snuggle bedsheet 102, according to an embodiment of the present invention. The snuggle bedsheet 102 may comprise the sheet fabric 104, the attachment fabric 106, and the spandex sheet 108. The user may lay down under the spandex sheet 108 through the proximal opening 124*a* provided at the proximal end 124 of the spandex sheet 108. The spandex sheet 108 may provide a concentrated compression and a firm support to the user while lying inside the spandex sheet 108, according to an embodiment of the present invention. In another embodiment of the present invention, the user may lay down under the spandex sheet 108 through the distal opening 126*a* provided at the distal end 126 of the spandex sheet 108. The spandex sheet 108 may provide the concentrated compression and provide the firm support to the user while lying inside the spandex sheet 108. The spandex sheet 108 may enable a wide expansion of the enclosed space of the spandex sheet 108 to allow the user to accommodate feet in any direction. According to embodiments of the present invention, the snuggle bedsheet 102 may further provide the user a full autonomy to get in and out of a bed with an ideal simulation provided by the pressure applied by spandex sheet 108.

Figure 2A:
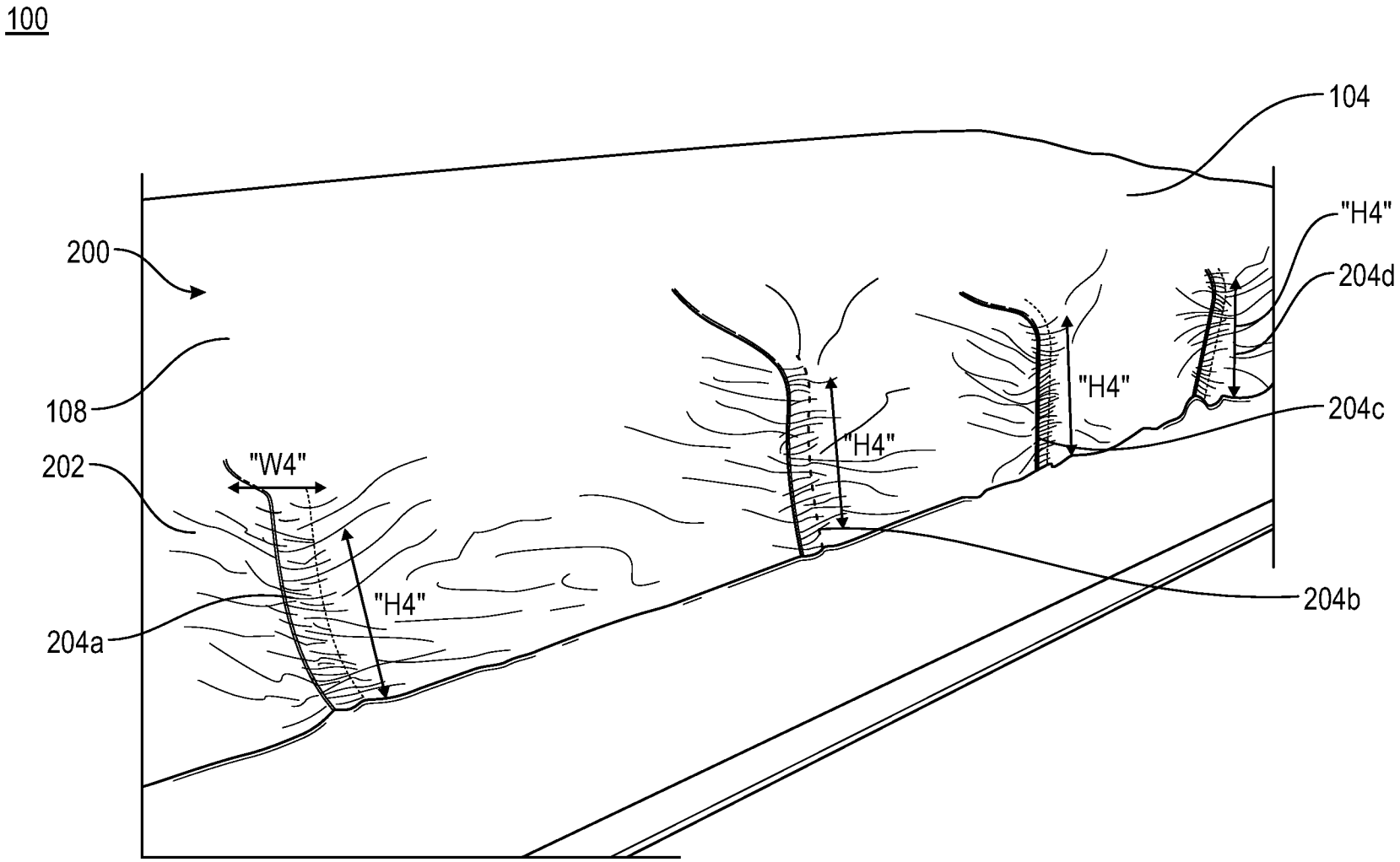
FIG. 2A illustrates an enlarged side view of the bedding apparatus having a snuggle bedsheet, according to another embodiment of the present invention.

FIG. 2A illustrates an enlarged side view of the bedding apparatus 100 having a snuggle bedsheet 200, according to another embodiment of the present invention. The snuggle bedsheet 200 may comprise the sheet fabric 104, and the spandex sheet 108. According to an embodiment of the present invention, a right side 202, and a left side (not shown) of the sheet fabric 104 may comprise a plurality of elastic bands 204*a*-204*n* (hereinafter individually referred to as the elastic band 204) that may be stitched along a length of the spandex sheet 108. In an embodiment of the present invention, a width W4 of each of the elastic band 204 stitched along the length of the spandex sheet 108 on the right side 202 and the left side of the sheet fabric 104 may be 1 inch. Further, a height H2 of each of the elastic band 204 stitched along the length of the spandex sheet 108 on the right side 202 and the left side of the sheet fabric 104 may be 9 inches, in an embodiment of the present invention. According to an embodiment of the present invention, a number of the elastic band 204 stitched along the length of the spandex sheet 108 on the right side 202 and the left side of the sheet fabric 104 may be in a range of 1 to 20. In an exemplary scenario, at least four elastic bands 204 may be stitched along the length of the spandex sheet 108 on each side such as, four elastic bands 204 may be stitched along a length of the right side 202 and four elastic bands 204 may be stitched along a length of the left side where the spandex sheet 108 is sewn.

Figure 2B:
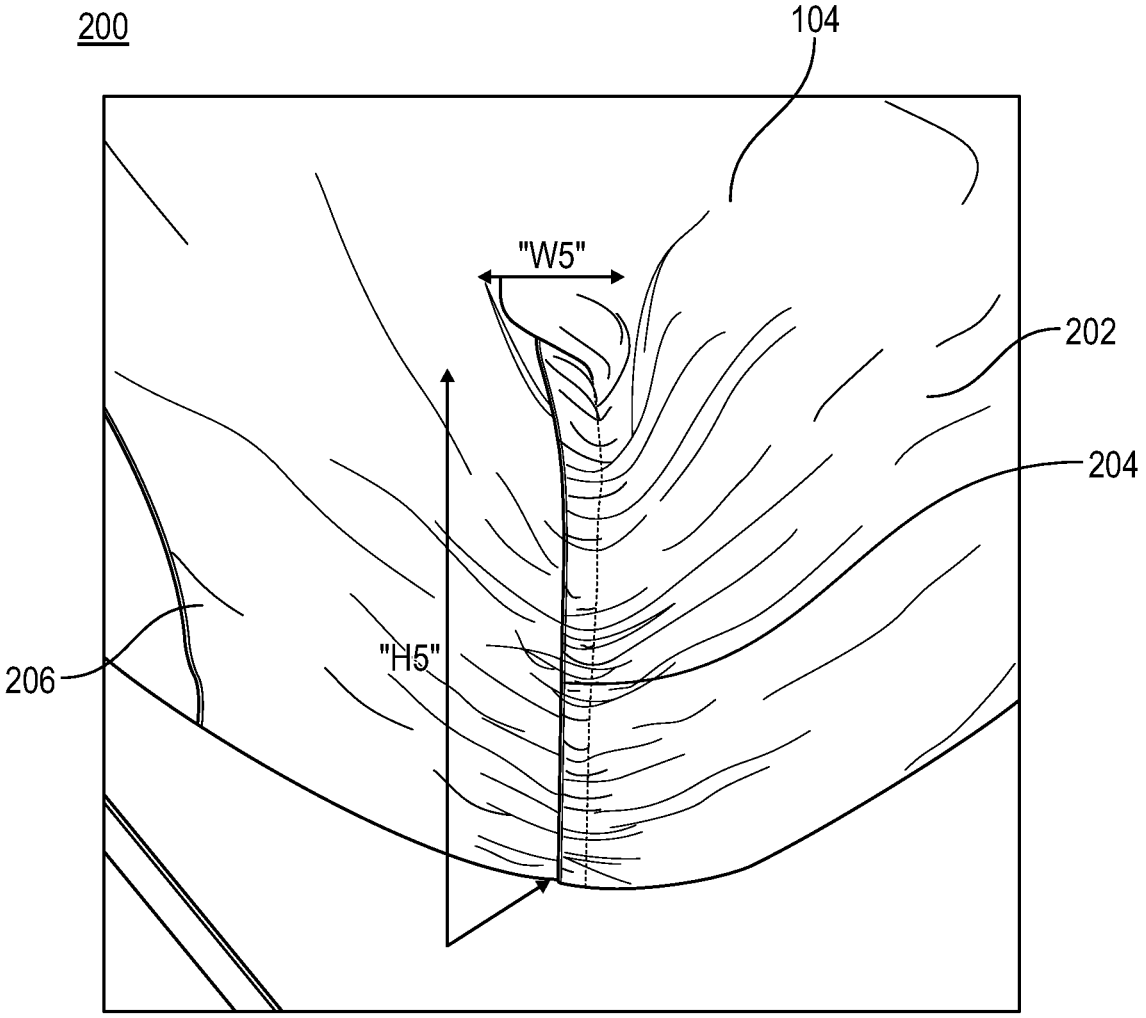
FIG. 2B illustrates a partial enlarged side view of the snuggle bedsheet installed over the mattress, according to an embodiment of the present invention.

FIG. 2B illustrates a partial enlarged side view of the snuggle bedsheet 200 installed over the mattress 128, according to an embodiment of the present invention. The snuggle bedsheet 200 may comprise the sheet fabric 104 and the elastic band 204. According to embodiments of the present invention, the sheet fabric 104 may comprise the right side 202 and a lower end 206. The right side 202 and the lower end 206 of the sheet fabric 104 may be attached at a corner seam through a stitching of the elastic band 204, in an embodiment of the present invention. In an embodiment of the present invention, the stitching may be done with a thread of the color matching to the color of the sheet fabric 104. According to embodiments of the present invention, a width W5 of the elastic band 204 may be 0.5 inch and a height of the elastic band 204 may be 9 inches.

Figure 2C:
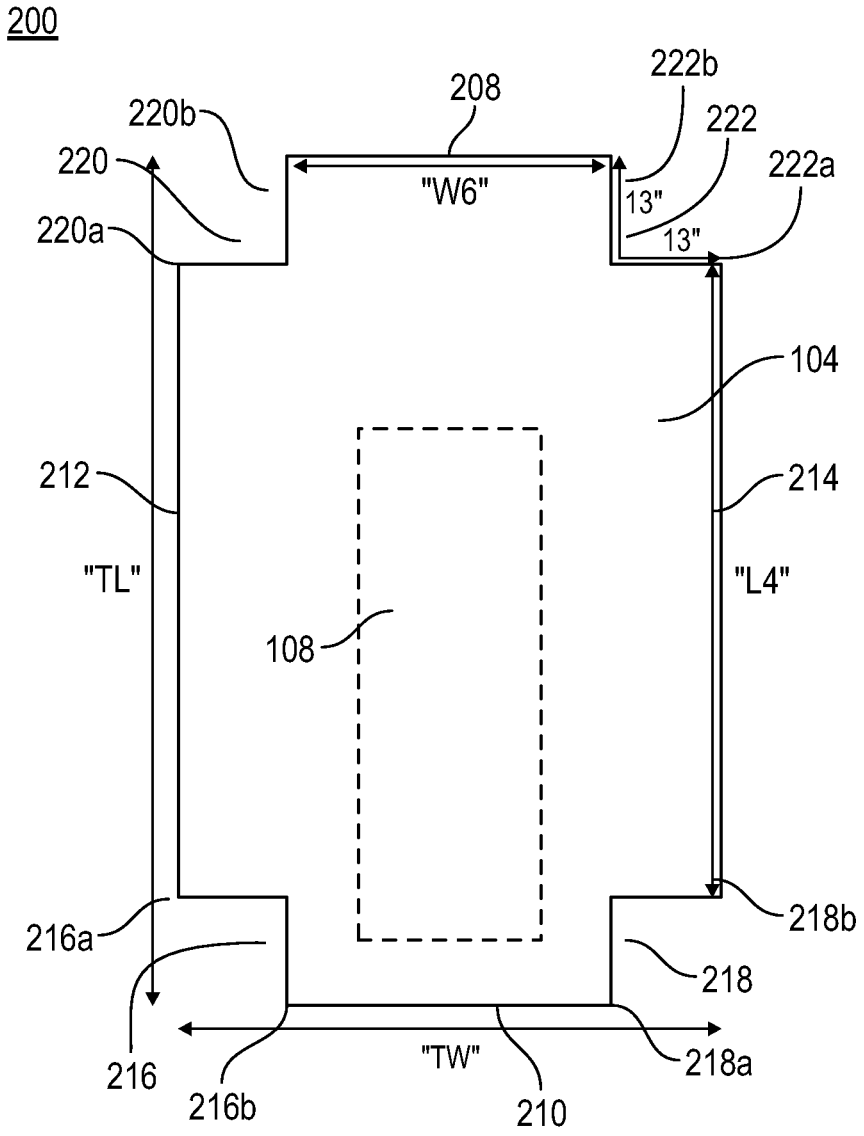
FIG. 2C illustrates dimensions of the snuggle bedsheet, according to another embodiment of the present invention.

FIG. 2C illustrates dimensions of the snuggle bedsheet 200, according to another embodiment of the present invention. The snuggle bedsheet 200 may comprise the sheet fabric 104 and the spandex sheet 108, in an embodiment of the present invention. Further, the sheet fabric 104 may comprise a top end 208, a bottom end 210, a left end 212, and a right end 214, according to embodiments of the present invention. In an embodiment of the present invention, the top end 208, the bottom end 210, the left end 212, and the right end 214 may form a plaque shape. In another embodiment of the present invention, the top end 208, the bottom end 210, the left end 212, and the right end 214 may form a cross shape. Further, in an embodiment of the present invention, the bottom end 210 and the left end 212 may form a first lip 216. In an embodiment of the present invention, the bottom end 210 and the right end 214 may form a second lip 218. In an embodiment of the present invention, the top end 208 and the left end 212 may form a third lip 220. In an embodiment of the present invention, the top end 208 and the right end 214 may form a fourth lip 222. According to embodiments of the present invention, a shape of the first lip 216, the second lip 218, the third lip 220, and the fourth lip 222 may be, but not limited to, a L-shaped lip, and so forth. Embodiments of the present invention are intended to include or otherwise cover any shape for the first lip 216, the second lip 218, the third lip 220, and the fourth lip 222. Further, the sheet fabric 104 may comprise a plurality of top pockets (not shown) that may be designed to enable the snuggle bedsheet 200 to be fitted with the mattress 128 of a variety of depths, in an embodiment of the present invention.

Further, the first lip 216 may comprise a plurality of legs 216*a* and 216*b* that may be perpendicularly aligned with each other forming an L-shaped lip, in an embodiment of the present invention. Further, the second lip 218 may comprise a plurality of legs 218*a* and 218*b* that may be perpendicularly aligned with each other, in an embodiment of the present invention. Further, the third lip 220 may comprise a plurality of legs 220*a* and 220*b* that may be perpendicularly aligned with each other, in an embodiment of the present invention. Further, the lip 222 may comprise a plurality of legs 222*a* and 220*b* that may be perpendicularly aligned with each other, in an embodiment of the present invention.

According to embodiments of the present invention, a width W6 of the bottom end 210 and the top end 208 of the sheet fabric 104 may be 39 inches. Further, a length L4 at the left end 212 and at the right end 214 of the sheet fabric 104 may be 76 inches, in an embodiment of the present invention. In an embodiment of the present invention, a length of the plurality of legs 216*a* and 216*b* of the first lip 216 of the sheet fabric 104 may be 13 inches. In an embodiment of the present invention, a length of the plurality of legs 218*a* and 218*b* of the second lip 218 of the sheet fabric 104 may be 13 inches. In an embodiment of the present invention, a length of the plurality of legs 220*a* and 220*b* of the third lip 220 of the sheet fabric 104 may be 13 inches. In an embodiment of the present invention, a length of the plurality of legs 222*a* and 222*b* of the fourth lip 222 of the sheet fabric 104 may be 13 inches. Further, a total length TL of the sheet fabric 104 may be 102 inches, according to embodiments of the present invention. Furthermore, a total width TW of the sheet fabric 104 may be 65 inches, according to embodiments of the present invention. According to embodiments of the present invention, the top end 208, the bottom end 210, the left end 212, and the right end 214 of the sheet fabric 104 may be designed to be fixedly attached with the mattress 128 using the elastic band 204.

Figure 2D:
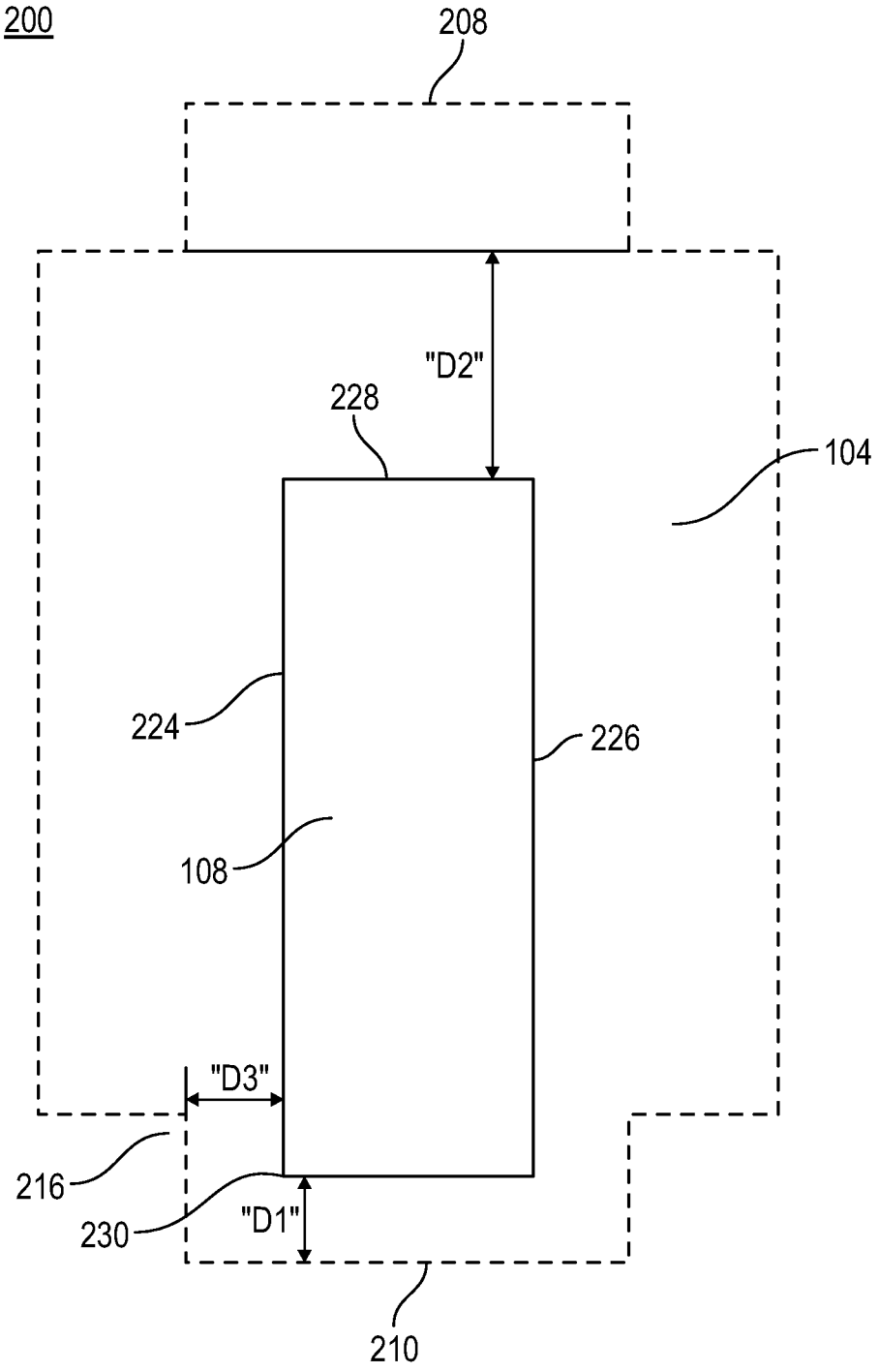
FIG. 2D illustrates dimensions of the snuggle bedsheet, according to another embodiment of the present invention.

FIG. 2D illustrates dimensions of the snuggle bedsheet 200, according to another embodiment of the present invention. According to embodiments of the present invention, the snuggle bedsheet 200 may further comprise the spandex sheet 108 that may be disposed in a middle area of the sheet fabric 104. In an embodiment of the present invention, the spandex sheet 108 may comprise a first end 224, a second end 226, a proximal end 228 and a distal end 230. In an embodiment of the present invention, a distance D1 between the bottom end 210 of the sheet fabric 104 and the distal end 230 of the spandex sheet 108 may be 8 inches. Further, a vertical distance D2 between the third lip 220 of the sheet fabric 104 and the proximal end 228 of the spandex sheet 108 may be 20 inches, in an embodiment of the present invention. In an embodiment of the present invention, a horizontal distance D3 between the first lip 216 and the first end 224 of the spandex sheet 108 may be 4 inches.

Figure 2E:
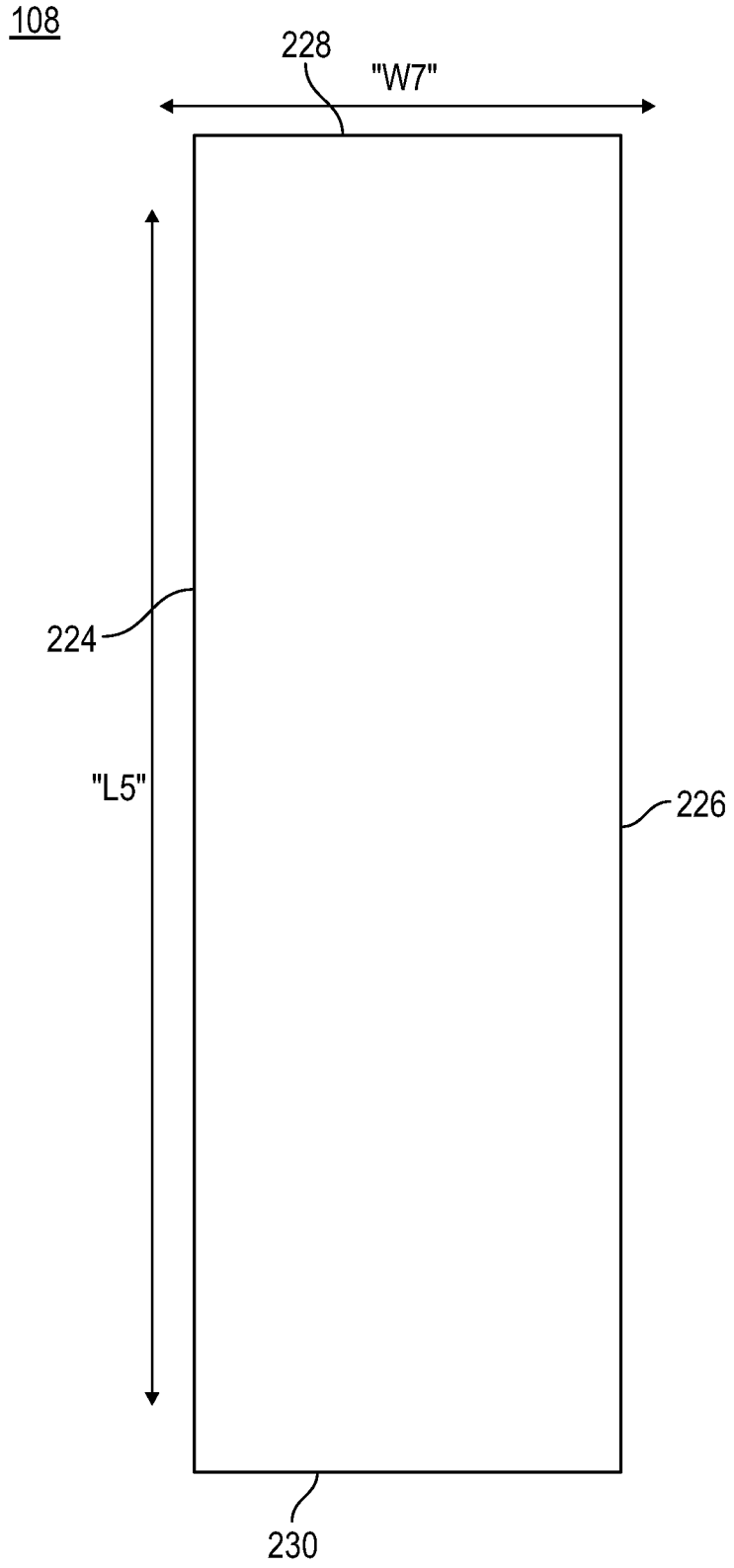
FIG. 2E illustrates dimensions of the spandex sheet of the snuggle bedsheet, according to an embodiment of the present invention.

FIG. 2E illustrates dimensions of the spandex sheet 108 of the snuggle bedsheet 200, according to an embodiment of the present invention. In an embodiment of the present invention, the spandex sheet 108 may comprise the first end 224, the second end 226, the proximal end 228 and the distal end 230. In an embodiment of the present invention, a width W7 the spandex sheet 108 may be 22 inches. In an embodiment of the present invention, a length L5 of the spandex sheet 108 may be 61 inches.

Figure 2F:
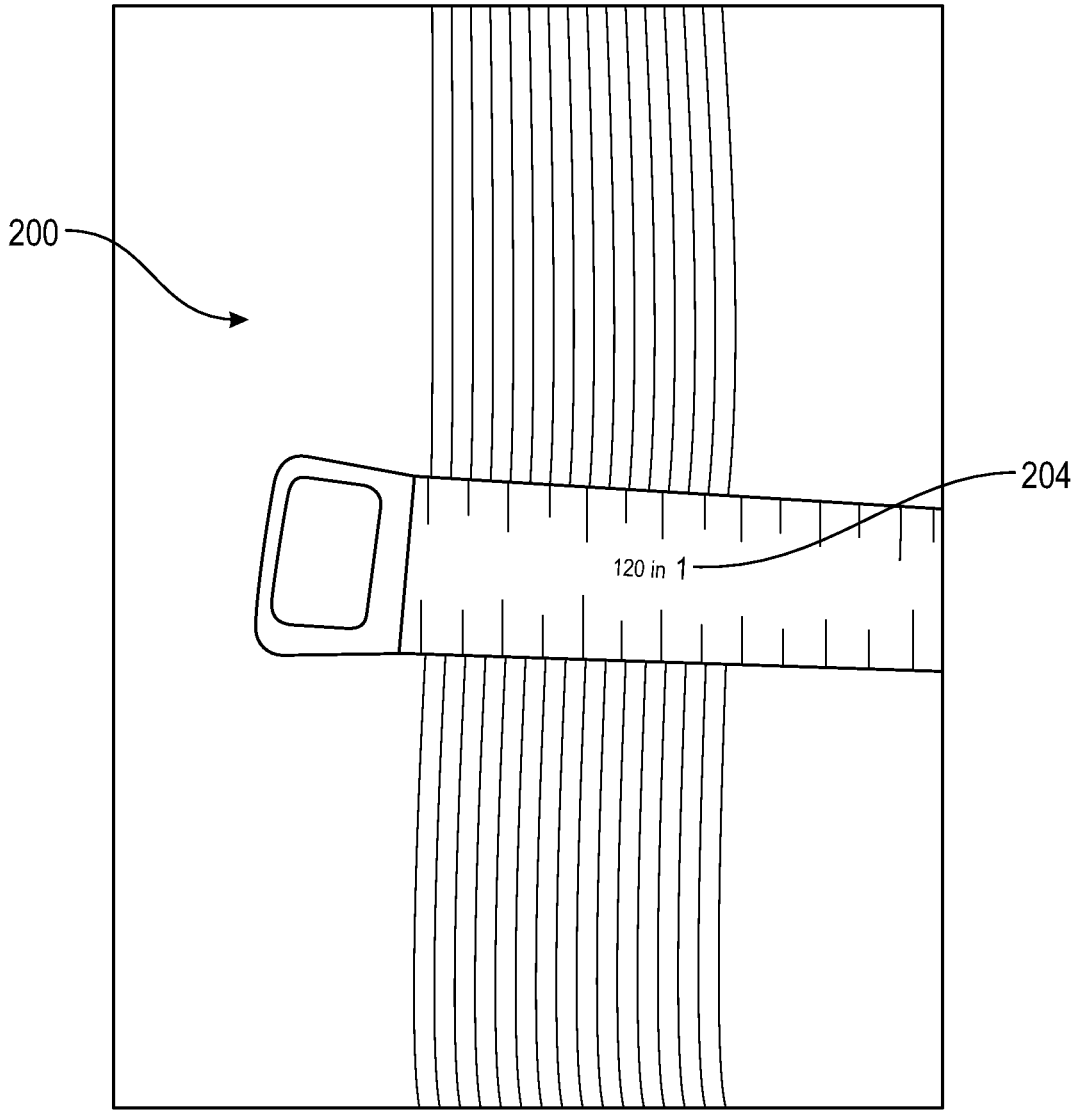
FIG. 2F illustrates an elastic band of the snuggle bedsheet, according to an embodiment of the present invention.

FIG. 2F illustrates the elastic band 204 of the snuggle bedsheet 200, according to an embodiment of the present invention. In an embodiment of the present invention, the elastic band 204 may be, but not limited to, a rectangular band, and so forth. The elastic band 204 may be made up of a material such as, but not limited to, a natural rubber, a synthetic rubber, a monomer, and so forth. Embodiments of the present invention are intended to include or otherwise cover any material of the elastic band 204, including known, related art, and/or later developed technologies that may be capable of providing an elasticity to the snuggle bedsheet 200 to secure it with the mattress 128 (as shown in the FIG. 1B). In an embodiment of the present invention, a width of the elastic band 204 that may be used at a plurality of corner seams of the mattress 128 to secure the snuggle bedsheet 200 with the mattress 128 may be 0.5 inch. In another embodiment of the present invention, the width of the elastic band 204 that may be used along a length of the spandex sheet 108 may be 1 inch. Further, a total length of the elastic band 204 used in the snuggle bedsheet 200 may be 139.25 inches, in an embodiment of the present invention.

Figure 3:
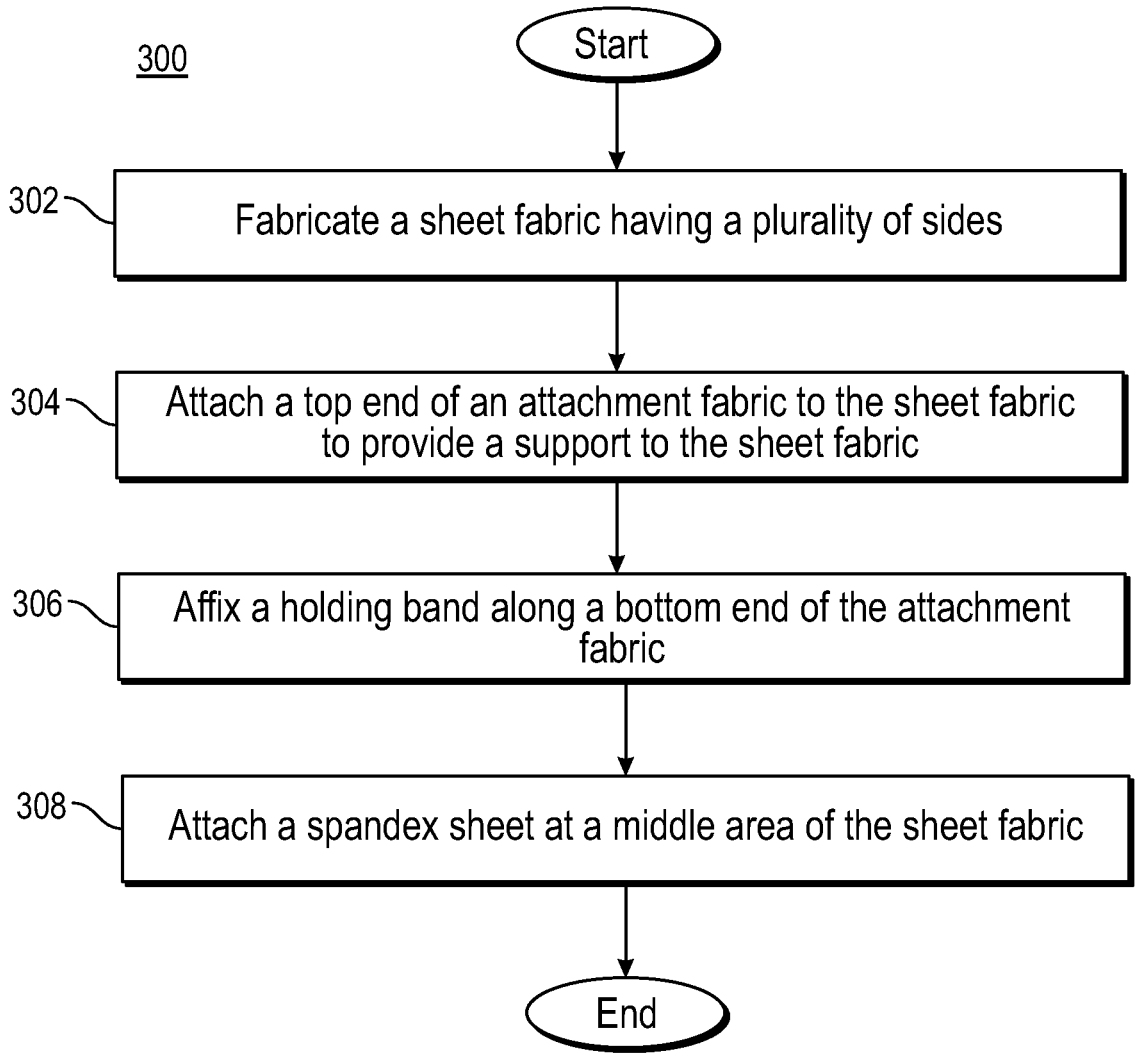
FIG. 3 illustrates a flow chart representing a method for fabrication of the snuggle bedsheet, according to an embodiment of the present invention.

FIG. 3 illustrates a flow chart representing a method 300 for fabrication of the snuggle bedsheet 102, according to an embodiment of the present invention.

At step 302, the sheet fabric 104 of a pre-defined shape and a pre-defined size may be fabricated that may have the upper side 110, the lower side 112, the left side 114, and the right side 116.

At step 304, the top end 118*a* of the attachment fabric 106 may be attached to the upper side 110, the lower side 112, the left side 114, and the right side 116 of the sheet fabric 104 to provide a support to the sheet fabric 104.

At step 306, the holding band 132 may be affixed along the bottom end 118*b* of the attachment fabric 106 to keep the attachment fabric 106 in place with the mattress 128.

At step 308, the spandex sheet 108 may be attached on a middle area of the sheet fabric 104.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to a bedding apparatus. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

I claim:

1. A bedding apparatus, comprising:

a snuggle bedsheet adapted to fit over a mattress, wherein the snuggle bedsheet comprises:

a sheet fabric adapted to cover a top portion of the mattress;

an attachment fabric having a top end and a bottom end such that the top end of the attachment fabric is attached to the sheet fabric to enclose the mattress; and a spandex sheet, attached at a middle area of the sheet fabric, comprising two longitudinal sides and two lateral sides, wherein the longitudinal sides are stitched to the sheet fabric and are longer than the lateral sides, and wherein both lateral sides are configured to be open at all times.

2. The apparatus of claim 1, wherein the attachment fabric is a knitted fabric.

3. The apparatus of claim 1, further comprising a pillowcase adapted to cover a pillow for protection from dust mites and stains.

4. The apparatus of claim 1, further comprising a holding band attached along the bottom end of the attachment fabric to keep the attachment fabric affixed to the mattress.

5. The apparatus of claim 1, wherein the spandex sheet is stretchable in a direction selected from at least one of a lengthwise direction, a transverse direction, or a combination thereof.

6. The apparatus of claim 1, wherein the attachment fabric is stretchable in a vertically downward direction to a range of 18 inches to 23 inches.

7. The apparatus of claim 1, wherein a width of the spandex sheet is in a range of 20 inches to 26 inches and a length of the spandex sheet is in a range of 52 inches to 65 inches.

8. A bedding apparatus, comprising:

a snuggle bedsheet adapted to fit over a mattress, wherein the snuggle bedsheet comprises:

a sheet fabric adapted to cover a top portion of the mattress;

an attachment fabric having a top end and a bottom end such that the top end of the attachment fabric is attached to the sheet fabric to enclose the mattress, wherein the attachment fabric is a knitted fabric; and a spandex sheet attached at a middle area of the sheet fabric, comprising two longitudinal sides and two lateral sides, wherein the longitudinal sides are stitched to the sheet fabric and are longer than the lateral sides, and wherein both lateral sides are configured to be open at all times.

9. The apparatus of claim 8, further comprising a pillowcase adapted to cover a pillow for protection from dust mites and stains.

10. The apparatus of claim 8, further comprising a holding band attached along the bottom end of the attachment fabric to keep the attachment fabric affixed to the mattress.

11. The apparatus of claim 8, wherein the spandex sheet is stretchable in a direction selected from one of a lengthwise direction, a transverse direction, or a combination thereof.

12. The apparatus of claim 8, wherein the attachment fabric is stretchable in a vertically downward direction to a range of 18 inches to 23 inches.

13. The apparatus of claim 8, wherein a width of the spandex sheet is in a range of 20 inches to 26 inches and a length of the spandex sheet is in a range of 52 inches to 65 inches.

14. A bedding apparatus, comprising:

a snuggle bedsheet adapted to fit over a mattress, wherein the snuggle bedsheet comprises:

a sheet fabric adapted to cover a top portion of the mattress;

an attachment fabric having a top end and a bottom end such that the top end of the attachment fabric is attached to the sheet fabric to enclose the mattress;

a holding band attached along the bottom end of the attachment fabric to keep the attachment fabric affixed to the mattress; and a spandex sheet attached at a middle area of the sheet fabric, comprising two longitudinal sides and two lateral sides, wherein the longitudinal sides are stitched to the sheet fabric and are longer than the lateral sides, wherein both lateral sides are configured to be open at all times.

15. The apparatus of claim 14, wherein the attachment fabric is a knitted fabric.

16. The apparatus of claim 14, further comprising a pillowcase adapted to cover a pillow for protection from dust mites and stains.

17. The apparatus of claim 14, wherein the spandex sheet is stretchable in a direction selected from one of a lengthwise direction, a transverse direction, or a combination thereof.

18. The apparatus of claim 14, wherein the attachment fabric is stretchable in a vertically downward direction to a range of 18 inches to 23 inches.

19. The apparatus of claim 14, wherein a width of the spandex sheet is in a range of 20 inches to 26 inches and a length of the spandex sheet is in a range of 52 inches to 65 inches.

20. The apparatus of claim 14, wherein a length of the sheet fabric is in a range of 37 inches to 42 inches and a height of the sheet fabric is in a range of 72 inches to 78 inches.

* * * * *